US010247084B2

(12) United States Patent
Makino

(10) Patent No.: US 10,247,084 B2
(45) Date of Patent: Apr. 2, 2019

(54) REGULATING MEMBER

(71) Applicant: UCHIYAMA MANUFACTURING CORP., Okayama (JP)

(72) Inventor: Koji Makino, Okayama (JP)

(73) Assignee: UCHIYAMA MANUFACTURING CORP., Okayama (JP)

( * ) Notice: Subject to any disclaimer, the term of this patent is extended or adjusted under 35 U.S.C. 154(b) by 114 days.

(21) Appl. No.: 15/537,974

(22) PCT Filed: Dec. 22, 2015

(86) PCT No.: PCT/JP2015/085777
§ 371 (c)(1),
(2) Date: Jun. 20, 2017

(87) PCT Pub. No.: WO2016/104478
PCT Pub. Date: Jun. 30, 2016

(65) Prior Publication Data

US 2017/0350306 A1 Dec. 7, 2017

(30) Foreign Application Priority Data

Dec. 22, 2014 (JP) ..... 2014-258239

(51) Int. Cl.
*F01P 7/14* (2006.01)
*F02F 1/14* (2006.01)
*F28F 13/00* (2006.01)

(52) U.S. Cl.
CPC ..... *F01P 7/14* (2013.01); *F02F 1/14* (2013.01); *F28F 13/003* (2013.01); *F01P 2007/143* (2013.01); *F28F 2275/125* (2013.01)

(58) Field of Classification Search
CPC ..... F01P 7/14; F02F 1/14; F28F 13/003
See application file for complete search history.

(56) References Cited

U.S. PATENT DOCUMENTS 9,032,916 B2 * 5/2015 Nishio ..... F02F 1/10 123/41.79
2003/0230253 A1 * 12/2003 Matsutani ..... F01P 3/02 123/41.74

FOREIGN PATENT DOCUMENTS

JP 63008018 A2 1/1988
JP 08296495 11/1996
(Continued)

OTHER PUBLICATIONS

International Search Report dated Mar. 8, 2016 filed in PCT/JP2015/085777.

*Primary Examiner* — Kevin A Lathers
(74) *Attorney, Agent, or Firm* — Rankin, Hill & Clark LLP

(57) ABSTRACT

There is provided a novel regulating member that ensures easy manufacturing and does not adversely affect cooling water and environment. A spacer 6 is inserted from an opening 30 of a cooling water flow passage 3 into the cooling water flow passage 3 to be disposed. The cooling water flow passage 3 is disposed in a cylinder block 1 in an internal combustion engine. The spacer 6 includes a supporting member 7 with rigidity formed into a shape configured to be disposed in the cooling water flow passage 3 and a regulating portion 8 supported by the supporting member 7. The regulating portion 8 regulates a flow of cooling water. The regulating portion 8 includes a cellulose-based sponge 81. The cellulose-based sponge 81 is restorable from a compressed state through a contact with the cooling water w.

16 Claims, 10 Drawing Sheets

(56) References Cited

FOREIGN PATENT DOCUMENTS

| | | | |
|---|---|---|---|
| JP | 2000345838 | A2 | 12/2000 |
| JP | 2002266695 | A2 | 9/2002 |
| JP | 2007107426 | A2 | 4/2007 |
| JP | 2007162473 | A2 | 6/2007 |
| JP | 3967636 | B2 | 8/2007 |
| JP | 2007247590 | A2 | 9/2007 |
| JP | 4149322 | | 9/2008 |
| JP | 4465313 | B2 | 5/2010 |
| JP | 5593136 | B2 | 9/2014 |

* cited by examiner (a)

(b)

(a)

(b)

(a)

(b)

REGULATING MEMBER

TECHNICAL FIELD

The present invention relates to a regulating member inserted into a cooling water passage (water jacket) disposed at a cylinder block in an internal combustion engine for use.

BACKGROUND ART

Into a water jacket in the internal combustion engine, a spacer as a regulating member to regulate a flow of cooling water flowing through the water jacket (such as a flow rate and a flow velocity) is inserted from an opening to be disposed. To insert the spacer into the water jacket from the opening, eliminating an insertion load to improve attachability is desired. PATENT LITERATURES 1 to 4 disclose a spacer with a small thickness before being inserted into a water jacket and increasing the thickness after the insertion to regulate a flow of predetermined cooling water. Configurations to improve attachability by eliminating the insertion load when the spacers disclosed in these PATENT LITERATURES are inserted into the water jackets are roughly classified as follows.

a) The spacer where a foamed rubber fixed in a compressed state by a binder (water-soluble substance) returns to an uncompressed state through melting of the binder by cooling water (antifreeze: LLC) flowing into the water jacket (see PATENT LITERATURES 1 and 2).

b) The spacer where a foamed rubber fixed in a compressed state by a binder (thermoplastic substance) returns to an uncompressed state through softening or melting the binder by a temperature of cooling water (see PATENT LITERATURES 1, 2, and 4).

c) The spacer configured such that a water-absorbent high-polymer material combined in an elastomer absorbs cooling water to expand the elastomer (see PATENT LITERATURE 3).

d) The spacer supported by a compressed spring member and after the insertion, the spring member is restored (see PATENT LITERATURE 1).

CITATION LIST

Patent Literature

PATENT LITERATURE 1: Japanese Patent No. 3967636
PATENT LITERATURE 2: Japanese Patent No. 4149322
PATENT LITERATURE 3: Japanese Patent No. 4465313
PATENT LITERATURE 4: Japanese Patent No. 5593136

SUMMARY OF THE INVENTION

Problems to be Solved by the Invention

The spacers configured like a) to d) each have the following problems.

In the cases of a) and b), the foamed rubber needs to be impregnated into a solution or an emulsion as a binder in a manufacturing process. This requires a management of the impregnating solution and a consideration for environment. The binder constituent possibly mixes in the LLC, affecting the constituent of the LLC.

In the case of c), to regulate the expansion direction of the water-swellable elastomer, the water-swellable elastomer needs to be processed integrally with a core material. Therefore, a complex process is required for the manufacturing. The water-absorbent high-polymer material possibly flows out in the LLC, affecting the constituent of the LLC.

In the case of d), the compression and the restoration actions of the spring member are used. This requires an incorporation of a mechanical mechanism to maintain the spring member in the compressed state or to release this compressed state. This make the structure complicated.

An object of the present invention in consideration of the above-described problems is to provide a novel regulating member that can be easily manufactured and does not adversely affect cooling water and environment.

Solution to the Problems

A regulating member of the present invention comprises: a supporting member with rigidity formed into a shape configured to be disposed in the cooling water flow passage flowing through the cooling water flow passage; and a regulating portion supported by the supporting member, the regulating portion regulating a flow of cooling water, wherein the regulating portion includes a cellulose-based sponge, the cellulose-based sponge being restorable from a compressed state through a contact with the cooling water flowing through the cooling water flow passage.

With the regulating member according to the present invention, to dispose the regulating member at the cooling water flow passage, configuring the regulating portion in a compressed state allows the regulating portion to be inserted into the cooling water flow passage while a load does not act on the regulating portion. This improves attachability of the regulating member to the cylinder block. When the cooling water flows through the cooling water flow passage, the regulating portion contacts the cooling water and is restored from the compressed state. Therefore, the regulating portion approaches or contacts a wall surface of the cooling water flow passage. This provides a function to regulate the cooling water. The cellulose-based sponge constituting the regulating portion has the following properties. That is, drying the pressurized cellulose-based sponge maintains the cellulose-based sponge in the compressed state by hydrogen bonding between cellulose molecules. Meanwhile, exposing the cellulose-based sponge in this state to the cooling water dissociates the hydrogen bonding between the cellulose molecules by water molecules. Thus, the cellulose-based sponge is restored from the compressed state. Accordingly, the regulating portion can be held in the compressed state without the use of a binder solution, an emulsion, and the like. Therefore, a processing operation of the regulating portion can be simplified. This eliminates a concern on a negative effect to the cooling water and environment.

In the regulating member of the present invention, the regulating portion may further include a protecting material, the protecting material coating at least a part of a surface opposed to a wall surface of the cooling water flow passage of the cellulose-based sponge, the protecting material having a strength larger than a strength of the cellulose-based sponge.

This allows restraining damage of the regulating portion even if the regulating member touches an edge portion or a wall surface of the opening when the regulating member is inserted into the cooling water flow passage. This also ensures restraining an abrasion and the damage of the regulating member disposed in the cooling water flow passage due to a vibration of the internal combustion engine or a water flow.

In this case, the protecting material may be made of an elastic material. According to this, the elastic protecting material coats a surface of the regulating portion. Therefore, the regulating portion easily adheres to the wall surface of the cooling water flow passage via the protecting material. Accordingly, in the case where damming the flow of the cooling water is requested, this configuration allows reliably meeting the request.

In the regulating member of the present invention, a sum of thicknesses of the supporting member and the compressed regulating portion may be smaller than a width of the cooling water flow passage.

This allows the regulating member to be free from the load when the regulating member is inserted into the cooling water flow passage.

In the regulating member of the present invention, a surface of the regulating portion restored from the compressed state may be configured to abut on an opposed wall surface of the cooling water flow passage.

According to this, when the regulating portion contacts the cooling water and is restored, the regulating portion abuts on an opposed wall surface of the cooling water flow passage. Accordingly, in the case where damming the flow of the cooling water is requested, this configuration allows reliably meeting the request.

In the regulating member of the present invention, the supporting member may include an arc portion formed along an outer shape of a cylinder bore wall disposed in the internal combustion engine, and the regulating portion may be fixedly secured to the arc portion.

According to this, the regulating portion is fixedly secured to the arc portion formed along the outer shape of the cylinder bore wall. Therefore, the flow (a flow rate, a flow velocity, and the like) of the cooling water flowing through the inside of the cooling water flow passage is regulated to be dammed. Thus, a temperature of the cylinder bore wall can be properly controlled.

In this case, the supporting member may include a plurality of the arc portions and a coupling portion, the coupling portion coupling the adjacent arc portions, and the regulating portions may be dividedly disposed at a plurality of the respective arc portions not to cross the coupling portion.

According to this, the regulating portions are divided so as not to cross the coupling portion. Therefore, this ensures preventing hindrance of the restoration of the regulating portion due to a pulling of the regulating portion when the restoration from the compressed state and the like.

In the regulating member of the present invention, at least a part of a plurality of the regulating portions may adjacently overlap in a depth direction of the cooling water flow passage.

According to this, the flow of the cooling water in an unintended direction such as a flow of the water in a gap between the regulating portion and the regulating portion, which is generated by plurally dividing the regulating portions, can be prevented.

In the regulating member of the present invention, the regulating portion may be disposed on a cylinder bore side of the supporting member, and when a piston in the internal combustion engine is at a top dead center, the regulating portion may be disposed at a crankshaft side with respect to a position of a piston ring closest to a combustion chamber.

According to this, the flow rate of the flow of the cooling water flowing through the combustion chamber side when the piston reaches the top dead center can be increased. That is, cooling capability at a side of the cylinder bore wall where a high temperature is likely to occur is improved. Meanwhile, the cooling capability at a side of the cylinder bore wall where a high temperature is less likely to occur can be reduced. This allows properly cooling the cylinder bore wall.

In the regulating member of the present invention, the supporting member may be made of resin, and wherein a portion of the resin impregnates the regulating portion to fixedly secure the regulating portion to the spacer main body.

Alternatively, in the regulating member of the present invention, the cellulose-based sponge may be made of a cellulose derived from a pulp and of a reinforcing fiber.

Further, in the regulating member of the present invention, the cellulose-based sponge may be compressed such that a volume in the compressed state becomes 1% to 30% with respect to a volume in the non-compressed state.

And in the regulating member present invention, the regulating portion may be fixedly secured on each of an arc surface on the cylinder bore side and an arc surface on a side opposed to the cylinder bore.

Effect of the Invention

A regulating member according to the present invention can be easily manufactured and does not adversely affect cooling water and environment.

BRIEF DESCRIPTION OF THE DRAWINGS

FIG. 1 is a schematic plan view illustrating the regulating member inserted into a water jacket in a cylinder block in an internal combustion engine.

FIG. 3(*a*) illustrates this spacer inserted into the water jacket. FIG. 3(*b*) is a diagram illustrating this spacer when cooling water flows through an inside of the water jacket.

FIG. 4(*b*) is a cross-sectional view of an arrow taken along line Y-Y in FIG. 4(*a*).

FIG. 10(*a*) illustrates this regulating member disposed at the water jacket in the internal combustion engine. FIG. 10(*b*) further illustrates a state where the cooling water flows through the inside of the water jacket.

FIG. 11(*a*) illustrates this regulating member disposed at the water jacket in the internal combustion engine. FIG. 11(*b*) further illustrates a state where the cooling water flows through the inside of the water jacket.

FIG. 12 is a perspective cross-sectional view schematically illustrating an arrow portion taken along line Z-Z in FIG. 1.

FIG. 13 is a perspective cross-sectional view schematically illustrating the arrow portion taken along line Z-Z in FIG. 1.

FIGS. 14(*a*) and 14(*b*) are perspective cross-sectional views schematically illustrating the arrow portion taken along line Z-Z in FIG. 1.

DESCRIPTION OF THE EMBODIMENTS

Figure 1:
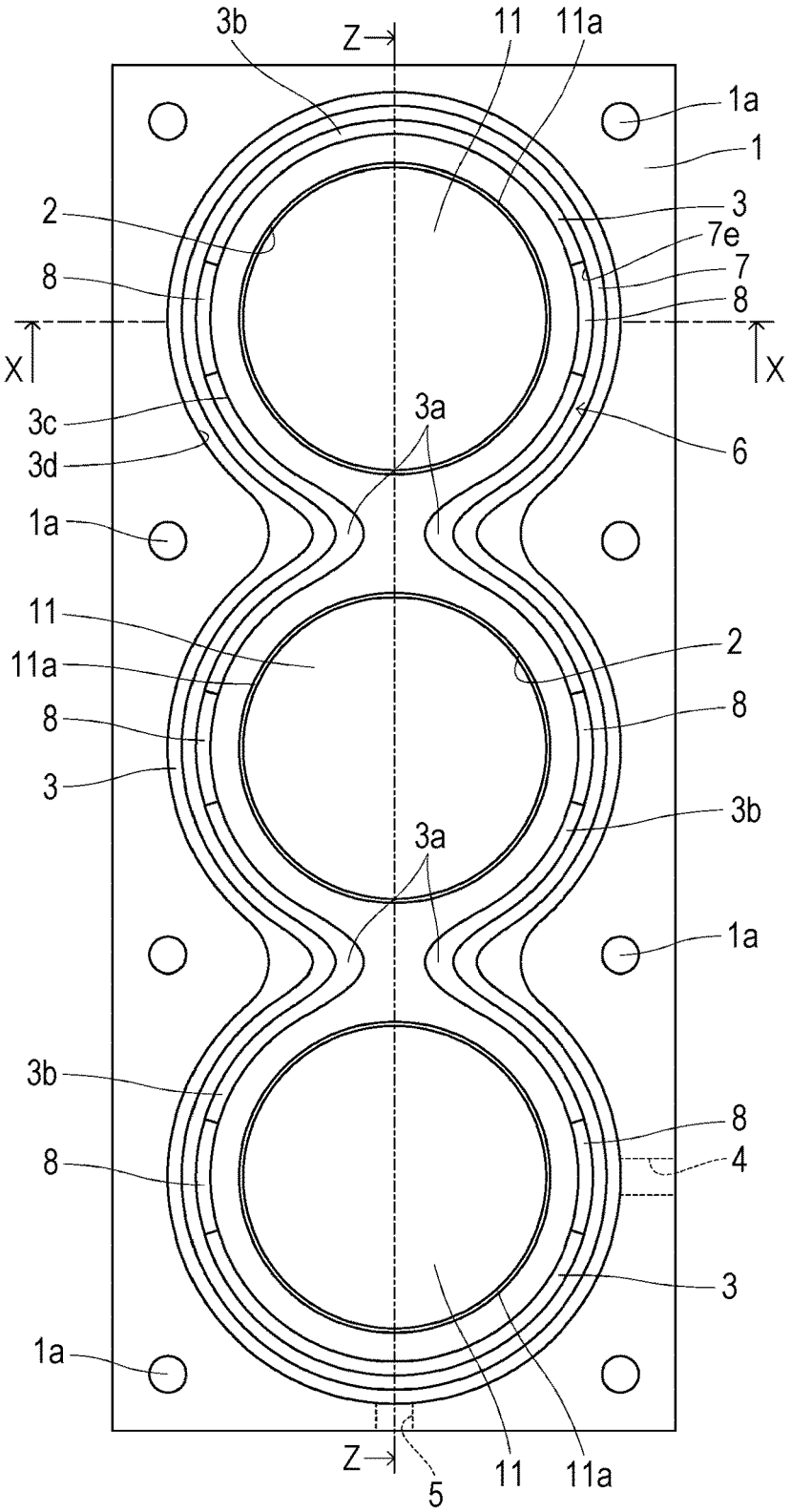
FIG. 1 illustrates a regulating member according to one embodiment of the present invention.
Figure 2:
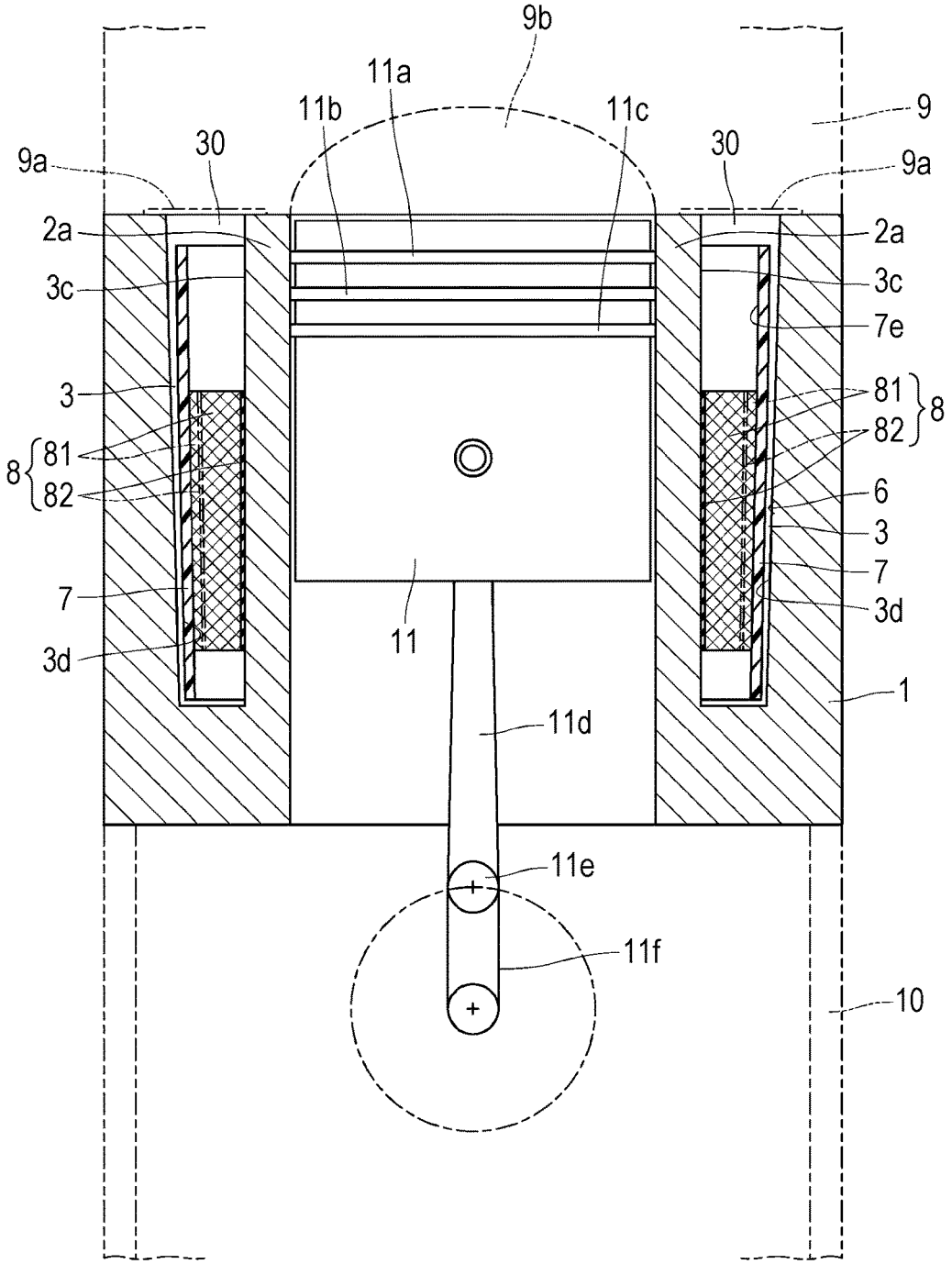
FIG. 2 is an enlarged cross-sectional view schematically illustrating an arrow portion taken along line X-X in FIG. 1.
Figure 3:
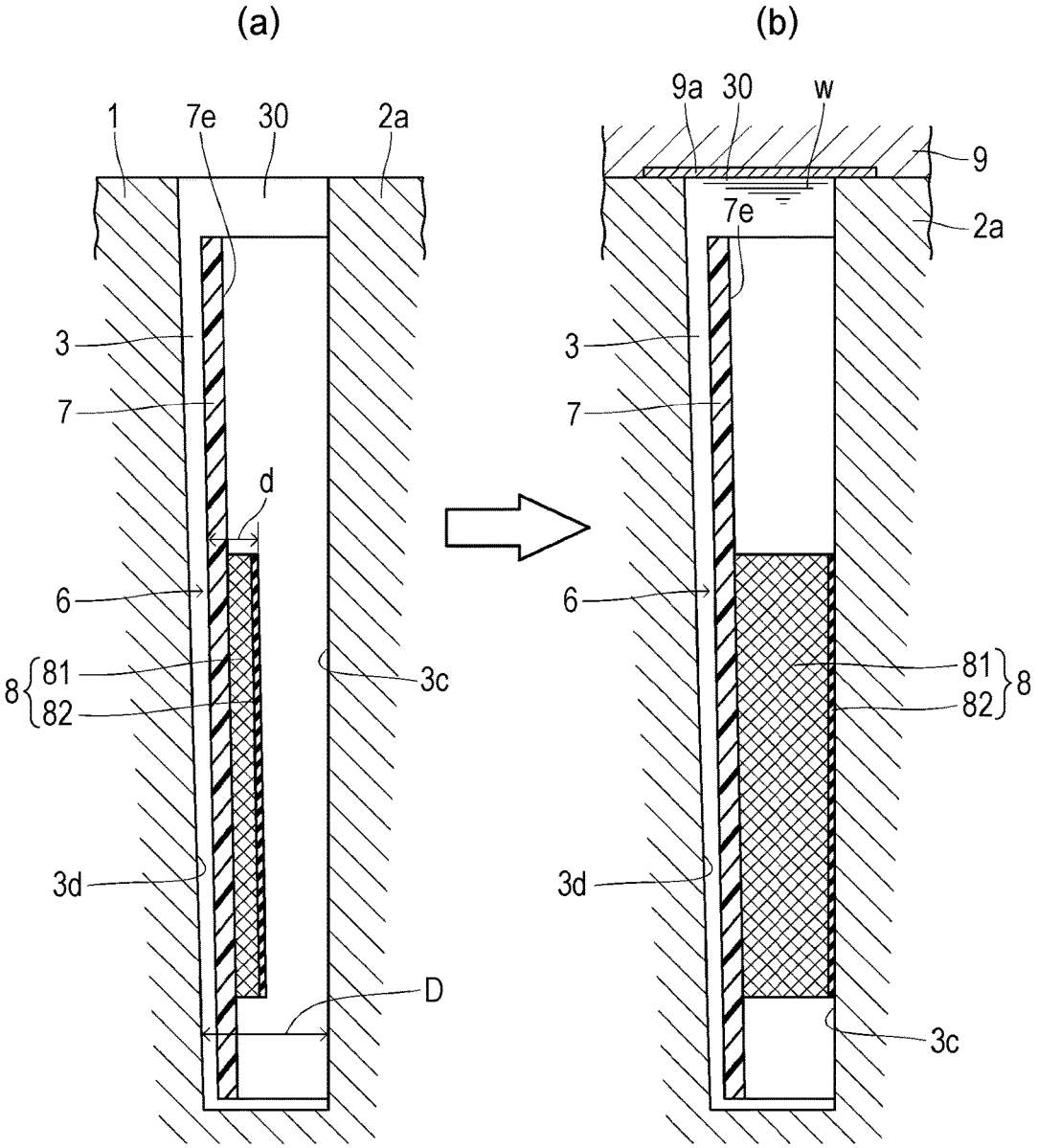
FIGS. 3(*a*) and 3(*b*) are diagrams schematically illustrating a process to attach the regulating member of the embodiment to the water jacket in the internal combustion engine.

The following describes embodiments of the present invention with reference to FIGS. 1 to 14. FIGS. 1 to 3 illustrate a regulating member according to one embodiment of the present invention. FIG. 1 illustrates a spacer as the regulating member of the embodiment inserted into a water jacket in a cylinder block in an internal combustion engine. A cylinder block 1 illustrated in FIG. 1 constitutes a three-cylinder automobile engine (internal combustion engine). Three pieces of cylinder bores 2 . . . are continuous in series in an adjacent state. Reference numeral 1*a* . . . denotes bolt (not illustrated) insertion holes to combine and tighten a cylinder head 9 (see FIG. 2) to the cylinder block 1. On peripheral areas of the three pieces of cylinder bores 2 . . . , an open deck-type water jacket (cooling water flow passage) 3 is formed successively. The cylinder block 1 includes a cooling water (includes antifreeze) introduction port 4 and a cooling water discharge port 5, which communicate with this water jacket 3. The cooling water discharge port 5 is coupled to a radiator (not illustrated) with pipe. An outlet side of the radiator is coupled to the cooling water introduction port 4 via a water pump (not illustrated) with pipe. Thus, FIG. 1 illustrates a configuration where the cooling water circulates between the water jacket 3 and the radiator. In the case where the cylinder head 9 also includes a water jacket (not illustrated), the cylinder block 1 and the cylinder head 9 are configured so as to communicate between the water jackets 3 in the cylinder block 1 and the water jackets in the cylinder head 9. In this case, the cylinder block 1 may not include the cooling water discharge port 5. Instead of this, the cylinder head 9 includes a cooling water discharge port. A pipe communicated with the radiator is coupled to the cooling water discharge port.

Narrowed portions 3*a* . . . , which mutually approach in a pair, are formed at parts between the adjacent cylinder bores 2 and 2 of the water jacket 3. A groove width of the narrowed portions 3*a* . . . is configured larger than a groove width of other arc portions 3*b* of the water jacket 3. A groove-side wall surface on the water jacket 3 is constituted of an inner wall surface 3*c* on the cylinder bore 2 side and an inner wall surface 3*d* on a side opposite to the cylinder bore 2, namely, both wall surfaces 3*c* and 3*d*. As illustrated in FIG. 1, a spacer 6 of this embodiment as the regulating member includes a tubular spacer main body (supporting member) 7 that can be inserted from an opening 30 of the water jacket 3 and disposed in the water jacket 3. Furthermore, the spacer 6 includes a regulating portion 8 supported to this spacer main body 7. The spacer main body 7 has rigidity. In the example in the diagram, the spacer main body 7 is formed of a molded body made of a hard synthetic resin. The regulating portion 8 of this embodiment includes a cellulose-based sponge 81 and a protecting material 82. A contact with the cooling water allows the cellulose-based sponge 81 to be restored from a compressed state. The protecting material 82 is made of a rubber material coating a surface of this cellulose-based sponge 81. That is, the protecting material 82 coats an entire surface of a side opposite to a side supported by the spacer main body 7 in the surface of the cellulose-based sponge 81. The cellulose-based sponge 81 is a natural material made of a cellulose derived from a pulp and a natural fiber (for example, a cotton) added as a reinforcing fiber. Since having a hydrophilic group (OH group), the cellulose has a property of easily blending in to a water content chemically. The cellulose-based sponge 81 is a porous material. Drying the pressurized cellulose-based sponge 81 maintains the cellulose-based sponge 81 in the compressed state by hydrogen bonding between cellulose molecules even without the use of the binder like the foamed rubber of the conventional example. Meanwhile, exposing the cellulose-based sponge 81 in this state to the cooling water dissociates the hydrogen bonding between the cellulose molecules by water molecules. The cellulose-based sponge 81 thus has the property of restoration from the compressed state.

Figure 4:
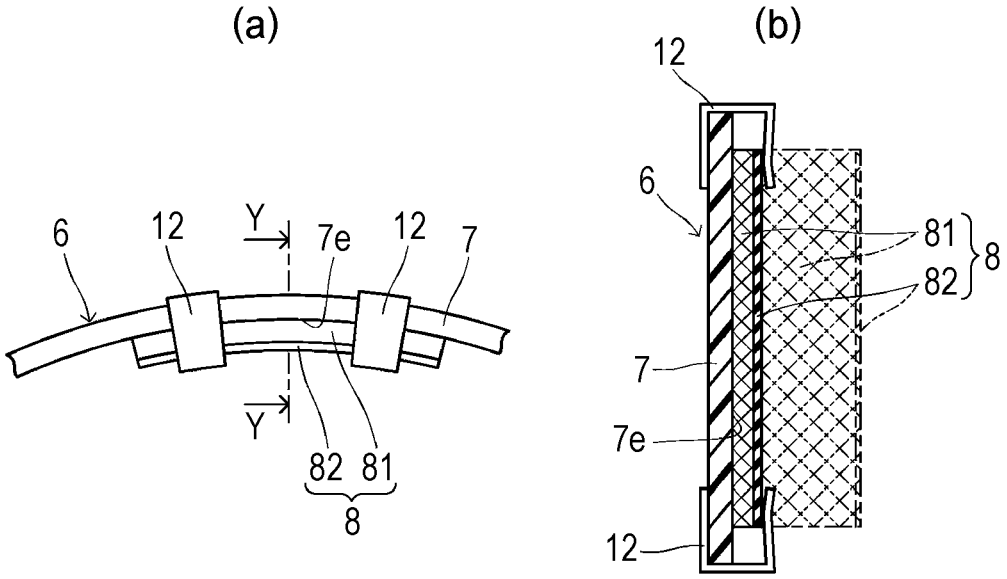
FIG. 4(*a*) is a plan view of main parts illustrating an exemplary structure where a supporting member supports the regulating member according to the embodiment.

The spacer 6 of this embodiment includes the spacer main body 7 and the regulating portions 8 . . . . The regulating portions 8 . . . are integrated with sites (six in the example in the diagram) of inner surfaces 7*e* (surfaces on the cylinder bore 2 side) of this spacer main body 7 and corresponding to the arc portions 3*b* of the water jacket 3. The spacer 6 illustrated in FIG. 2 is manufactured in the following manner. That is, a raw material of a cellulose-based sponge in a foaming state available in the market is compressed and dried in a thickness direction to be processed into a sheet-shaped body. As a concrete example, the raw material of the cellulose-based sponge is pressurized and heated by a press roller to be processed into the sheet shape. The protecting material 82 made of a rubber sheet is fixedly secured to and integrated with one surface of this sheet-shaped body with an adhesive or the like. Since the protecting material 82 made of the rubber sheet has strength larger than the cellulose-based sponge 81 (especially, toughness, rubfastness, and the like), the protecting material 82 is preferably employed. Note that, instead of the rubber sheet, a resin sheet or a metal sheet is also usable as the protecting material 82. The sheet-shaped body of the cellulose-based sponge fixedly secured to and integrated with the protecting material 82 is cut out to have a predetermined shape. Meanwhile, the spacer main body 7 is separately manufactured by injection molding. Afterwards, the adhesive fixedly secures the regulating portion 8 to the predetermined position on the spacer main body 7. Alternatively, the regulating portion 8 may be thermally welded to a site of a corresponding portion of the thermally-melted spacer main body 7. Further, with supporting structures as illustrated in FIGS. 4(*a*) to 9, the regulating portion 8 may be integrated with the spacer main body 7. The supporting structures illustrated in FIGS. 4(*a*) to 9 will be described later. Furthermore, the method for integrating the regulating portion 8 with the spacer main body 7 is not limited to above-described method. For example, the integration molding may be performed by insert molding. As one example, the following molding method is available. First, compressing a foam made of the cellulose-based sponge in the foaming state in a thickness direction processes the foam into the sheet shape.

Next, this foam compressed into the sheet shape is dried. Afterwards, an application of the adhesive to the one surface of the foam modifies the surface condition. Afterwards, the foam is disposed at a predetermined position in a low mold cavity in a molding apparatus and further an upper mold is mold-clamped. Then, by injecting a molten resin in the cavity, the insert molding is performed. Then, through a demolding process, the spacer 6 where the compressed foam, namely, the regulating portion 8 is formed integrally with the spacer main body 7 made of the resin can be obtained. With the spacer 6 thus formed, a part of the resin of the spacer main body 7 is impregnated into the regulating portion 8. This fixedly secures the regulating portion 8 to the spacer main body 7. This manufacturing process by the insert molding is also not limited to the above-described process.

The spacer 6 thus obtained is constituted of the spacer main bodies 7 and the regulating portions 8 . . . , which are fixedly secured to and integrated with the inner surfaces 7*e* on the spacer main bodies 7. In this case, the regulating portions 8 . . . have not yet restored to the state before the compression. The cellulose-based sponge 81 is fixedly secured so as to go along the inner surface 7*e* on the spacer main body 7. A sum d of thicknesses of the spacer main body 7 and the regulating portion 8 is configured smaller than a width D of the water jacket 3 with the compressed cellulose-based sponge 81 (see FIG. 3(*a*)). The spacer 6 is inserted from the opening 30 of the water jacket 3 to be disposed in the water jacket 3. Configuring the sum d of the thickness smaller than the width D of the water jacket 3 at this insertion ensures reducing an insertion load of this spacer 6. The cooling water is introduced from the cooling water introduction port 4 into the water jacket 3 and flows through the water jacket 3. Then, the cellulose-based sponges 81 of the respective regulating portions 8 are exposed to the cooling water. Dissociating the hydrogen bonding between the cellulose molecules by the water molecules restores the cellulose-based sponges 81 from the compressed state. This restoration causes the one surfaces on the regulating portions 8 . . . (surfaces on the sides integrated with the protecting materials 82) to abut on the inner wall surfaces (opposed wall surfaces) 3*c* on cylinder bore walls 2*a* side in the water jacket 3. In FIG. 2, the regulating portions 8 indicated by the two-dot chain lines indicate the compressed cellulose-based sponges 81. Meanwhile, the regulating portions 8 indicated by the solid lines indicate the restored cellulose-based sponges 81.

In the state illustrated in FIG. 2, the spacer 6 is disposed in the water jacket 3 in the cylinder block 1. The cylinder head 9 is integrally tightened to a top surface of the cylinder block 1. Furthermore, an oil pan 10 is tightened integrally with a lower surface of the cylinder block 1. Further, FIG. 2 illustrates a state where a piston 11 is incorporated between the cylinder bore 2 and the oil pan 10. The cylinder head 9 is tightened integrally with the cylinder block 1 so as to obstruct the opening 30 of the water jacket 3 via a cylinder head gasket 9*a*. With this tightened state, a combustion chamber 9*b* is positioned on an upper side opening of the cylinder bore 2. The cylinder bore 2 internally includes the piston 11, which includes a plurality of (three in the example in the diagram) piston rings 11*a*, 11*b*, and 11*c*. The piston 11 is reciprocatably disposed along the axial direction while sliding contact with the inner surfaces on the cylinder bore walls 2*a*. This reciprocation of the piston 11 is converted into an axis rotation motion (one-dot chain line) of a crankshaft 11*f* via a coupling rod 11*d* and a crank pin 11*e*. FIG. 2 illustrates the piston 11 at a top dead center. The regulating portion 8 is disposed at the spacer 6, which is disposed in the water jacket 3, on the cylinder bore 2 side of the spacer main body 7. With the piston 11 at the top dead center, the regulating portions 8 are disposed so as to be positioned on the crankshaft 11*f* side along a depth direction of the water jackets 3 with respect to the position of the piston ring 11*a* closest to the combustion chamber 9*b*.

Actuating an engine (internal combustion engine) configured as described above heats the cylinder bore walls 2*a* by the heat from the combustion chamber 9*b*. An excessively high temperature of the cylinder bore walls 2*a* degrades viscosity of oil attached to the piston rings 11*a, b*, and *c*. This flows out the oil, failing to a smooth reciprocating sliding motion of the piston 11 in the cylinder bore 2. Meanwhile, the cooling water flows through the inside of the water jackets 3. Therefore, restraining the overheating of the cylinder bore walls 2*a* restrains flowing out of the oil. This maintains the smooth reciprocation of the piston 11. The water jacket 3 internally includes the spacer 6 that includes the regulating portion 8. Therefore, the regulating portion 8 regulates so as to dam the flow (the flow rate, the flow velocity, and the like) of the cooling water flowing through the inside of the water jacket 3. Thus, the temperature of the cylinder bore wall 2*a* is properly controlled. Especially, the regulating portion 8 is disposed to have the positional relationship as described above with respect to the spacer main body 7. Therefore, the flow rate of the cooling water increases at the side close to the combustion chamber 9*b*. This effectively restrains the overheating of the cylinder bore wall 2*a* on the side close to the combustion chamber 9*b*. The presence of the regulating portion 8 regulates the flowing of the cooling water inside the water jacket 3. Overcooling of the cylinder bore wall 2*a* on the oil pan 10 side is also restrained. That is, cooling capability at a side of the cylinder bore wall 2*a* where a high temperature is likely to occur is improved. Meanwhile, the cooling capability at a side of the cylinder bore wall 2*a* where a high temperature is less likely to occur can be reduced. This allows properly cooling the cylinder bore wall 2*a*.

FIGS. 3(*a*) and 3(*b*) schematically illustrate a process to attach the spacer 6 of the embodiment to the water jacket 3. FIG. 3(*a*) illustrates a state where the spacer 6 manufactured as described above is inserted from the opening 30 into the water jacket 3 to be disposed. The sum d of the thicknesses of the spacer main body 7 and the regulating portion 8 is set as described above. Therefore, the regulating portion 8 does not interfere with an edge portion or the inner wall surfaces 3*c* and 3*d* of the opening 30 of the water jacket 3. The spacer 6 can be inserted into the water jacket 3 with the load not acting on. The protecting material 82 coats the surface of the cellulose-based sponge 81. Therefore, even if the surface of the regulating portion 8 touches the edge portion or the inner wall surface 3*c* or 3*d* of the opening 30 at this insertion, damage of the surface of the cellulose-based sponge 81 is restrained. As illustrated in FIG. 3(*b*), after the cylinder head 9 is tightened to and integrated with the cylinder block 1, cooling water w flows through the water jacket 3. Then, as described above, the cellulose-based sponge 81 is restored from the compressed state. Then, the surface of the regulating portion 8 (protecting material 82) abuts on the inner wall (opposed wall surface) 3*c* on the cylinder bore 2 side of the water jacket 3. Thus, with the surface of the regulating portion 8 abutting on the opposed wall surface 3*c*, the protecting material 82 coats the surface of the cellulose-based sponge 81. This ensures restraining abrasion and the damage of the regulating portion 8 caused by vibrations of the engine or the water flow. Moreover, the protecting material 82 is made of the elastic rubber material. Therefore, the regulating portion 8 easily adheres to the opposed wall surface 3*c* on the water jacket 3 via the protecting material 82. Accordingly, in the case where damming the flow of the cooling water w is required, this configuration allows reliably meeting the request. Furthermore, this allows the regulating portion 8 to be held in the compressed state without the use of chemicals and the like. Therefore, the processing operation of the regulating portion 8 can be simplified. This also eliminates a concern on a negative effect to the cooling water w and environment. Moreover, the cellulose-based sponge 81 as the natural material is available at a low price and does not adversely affect the natural environment. A disposal process and the like of the cellulose-based sponge 81 can be easily performed by incineration and the like. Furthermore, since the spacer main body 7 and the regulating portion 8 are coupled by their surfaces, the position of the regulating portion 8 with respect to the spacer main body 7 can be stabilized. Incidentally, like the conventional example, to fix the foamed rubber in the compressed state using the binder, the binder coats the surface of the foamed rubber. Therefore, the binder is interposed at an interface between the spacer main body and the foamed rubber. When such spacer is exposed to the cooling water, the binder, which is interposed at the interface between the spacer main body and the foamed rubber, is also exposed to the cooling water. There is a concern that dissolving the binder into the cooling water degrades adhesive strength between the spacer main body and the foamed rubber. In contrast to this, the use of the cellulose-based sponge does not cause such concern.

FIGS. 4(*a*) and 4(*b*) illustrate an exemplary structure where the spacer main body (supporting member) 7 supports the regulating portion 8 according to the embodiment. In this example, the regulating portion 8 is not fixedly secured to and integrated with the spacer main body 7 like the above-described examples. Instead of this, four clips 12 . . . , which are disposed at upper and lower end portions of the spacer main body 7 along the depth direction of the water jacket 3, interpose the regulating portion 8 together with the spacer main body 7 in the thickness direction to support the regulating portion 8 to the spacer main body 7. Thus, similar to the above-described examples, the spacer 6 including the regulating portion 8 supported to the spacer main body 7 by the clips 12 . . . is disposed in the water jacket 3 in the cylinder block 1. In this disposed state, the cooling water flows through the water jacket 3. When the cellulose-based sponge 81 of the regulating portion 8 contacts the cooling water, as indicated by the two-dot chain lines in FIG. 4(*b*), the cellulose-based sponge 81 restores the state before the compression excluding the parts interposed by the clips 12 . . . . Accordingly, the surface of the regulating portion 8 abuts on the inner wall surface 3*c* on the cylinder bore 2 side of the water jacket 3 (see FIGS. 2 and 3(*b*)). Accordingly, the spacer 6 of this example also provides the actions and the effects similar to the above-described examples.

Figure 5:
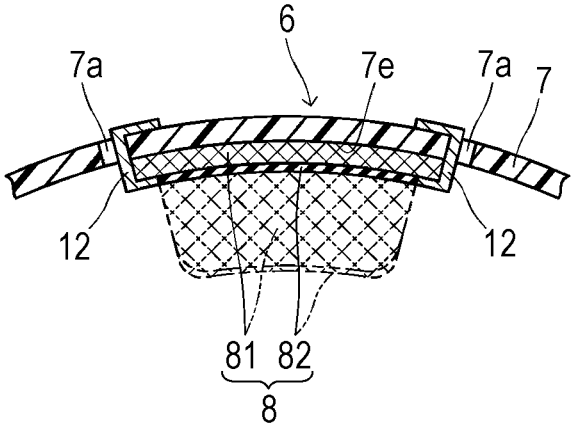
FIG. 5 is a traverse plan view of main parts illustrating another example of the supporting structure.

FIG. 5 illustrates another example of a structure where the spacer main body (supporting member) 7 supports the regulating portion 8 of the embodiment. In this example, a pair of vertically-elongated slit-shaped through holes 7*a* and 7*a* are bored passing through the thickness direction. The slit-shaped through holes 7*a* and 7*a* are disposed along a circumferential direction of the spacer main body 7 at approximately identical intervals in a circumferential length of the regulating portion 8. The pair of vertically-elongated clips 12 and 12 passing through and mounted to these through holes 7*a* and 7*a* interpose both ends of the cellulose-based sponge 81 in the circumferential direction of the regulating portion 8 in the thickness direction together with the spacer main body 7. Accordingly, the spacer main body 7 supports the regulating portion 8. Thus, similar to the above-described examples, the spacer 6 including the regulating portion 8 supported to the spacer main body 7 by the clips 12 and 12 is also disposed in the water jacket 3 in the cylinder block 1. In this disposed state, the cooling water flows through the water jacket 3. When the cellulose-based sponge 81 of the regulating portion 8 contacts the cooling water, as indicated by the two-dot chain lines, the cellulose-based sponge 81 restores the state before the compression excluding the parts interposed by the clips 12 and 12. Accordingly, the surface of the regulating portion 8 abuts on the inner wall surface 3*c* on the cylinder bore 2 side of the water jacket 3 (same as above). Accordingly, the spacer 6 of this example also provides the actions and the effects similar to the above-described examples.

Figure 6:
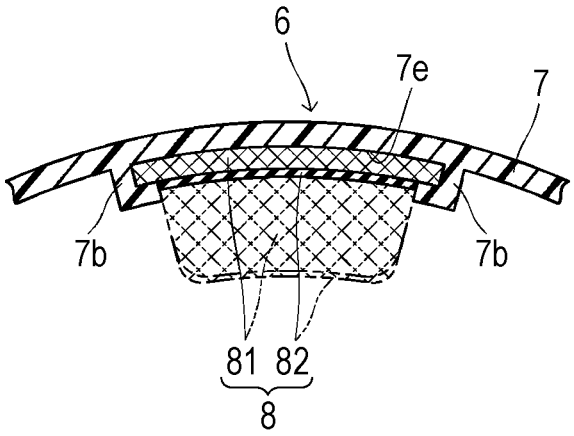
FIG. 6 is a traverse plan view of main parts illustrating yet another example of the supporting structure.

FIG. 6 illustrates yet another example of a structure where the spacer main body (supporting member) 7 supports the regulating portion 8 of the embodiment. In this example, a pair of vertically-elongated hook-shaped support pieces 7*b* and 7*b* project on the inner surface on the cylinder bore 2 side of the spacer main body 7. The hook-shaped support pieces 7*b* and 7*b* are disposed along the circumferential direction at approximately identical intervals in the circumferential length of the regulating portion 8 so as to be opposed to one another. The hook-shaped support pieces 7*b* and 7*b* interpose both end of the cellulose-based sponge 81 in the circumferential direction of the regulating portion 8 in the thickness direction together with the spacer main body 7. Accordingly, the spacer main body 7 supports the regulating portion 8. Thus, similar to the above-described examples, the spacer 6 including the regulating portion 8 supported to the spacer main body 7 by the hook-shaped support pieces 7*b* and 7*b* is also disposed in the water jacket 3 in the cylinder block 1. In this disposed state, the cooling water flows through the water jacket 3. When the cellulose-based sponge 81 of the regulating portion 8 contacts the cooling water, as indicated by the two-dot chain lines, the cellulose-based sponge 81 restores the state before the compression excluding the parts interposed by the hook-shaped support pieces 7*b* and 7*b*. Accordingly, the surface of the regulating portion 8 abuts on the inner wall surface 3*c* on the cylinder bore 2 side of the water jacket 3 (same as above). Accordingly, the spacer 6 of this example also provides the actions and the effects similar to the above-described examples.

Figure 7:
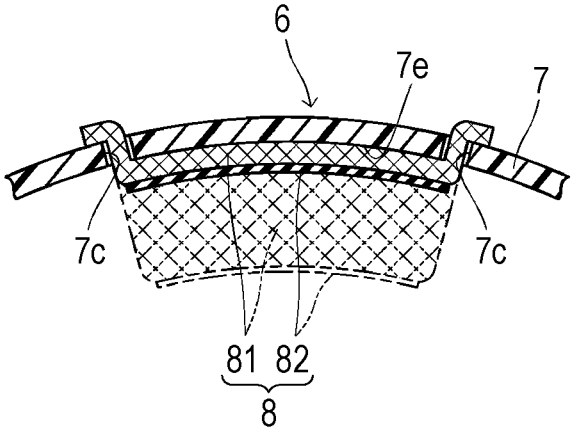
FIG. 7 is a traverse plan view of main parts illustrating yet another example of the supporting structure.

FIG. 7 illustrates yet another example of a structure where the spacer main body (supporting member) 7 supports the regulating portion 8 of the embodiment. In this example, a pair of vertically-elongated slit-shaped through holes 7*c* and 7*c* are bored passing through the thickness direction on the inner surface on the cylinder bore 2 side of the spacer main body 7. The slit-shaped through holes 7*c* and 7*c* are disposed along the circumferential direction at approximately identical intervals in the circumferential length of the regulating portion 8. Both ends in the circumferential direction of the cellulose-based sponge 81 of the regulating portion 8 are inserted from the cylinder bore 2 side into these through holes 7*c* and 7*c*. Furthermore, folding these both ends in directions opposite to one another supports the regulating portion 8 by the spacer main body 7. Thus, similar to the above-described examples, the spacer 6 including the regulating portion 8 supported to the spacer main body 7 via these through holes 7*c* and 7*c* is also disposed in the water jacket 3 in the cylinder block 1. In this disposed state, the cooling water flows through the water jacket 3. When the cellulose-based sponge 81 of the regulating portion 8 contacts the cooling water, as indicated by the two-dot chain lines, the cellulose-based sponge 81 restores the state before the compression by the part on the cylinder bore 2 side. Accordingly, the surface of the regulating portion 8 abuts on the inner wall surface 3*c* on the cylinder bore 2 side of the water jacket 3 (same as above). Accordingly, the spacer 6 of this example also provides the actions and the effects similar to the above-described examples.

Figure 8:
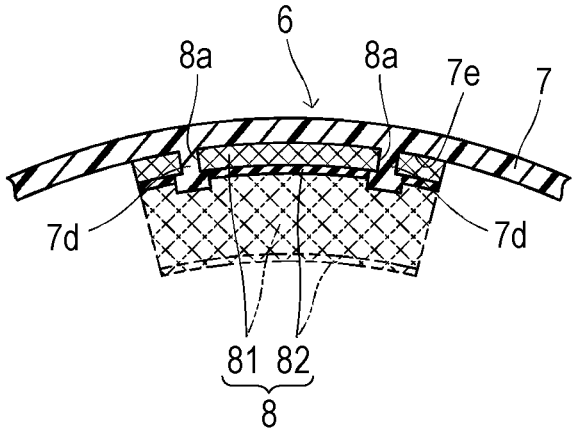
FIG. 8 is a traverse plan view of main parts illustrating yet another example of the supporting structure.

FIG. 8 illustrates yet another example of a structure where the spacer main body (supporting member) 7 supports the regulating portion 8 of the embodiment. In this example, the spacer main body 7 includes four pillar projections 7*d* . . . , which are vertically and horizontally spaced along the circumferential direction, on the inner surface on the cylinder bore 2 side. The regulating portion 8 includes through-holes 8*a* . . . at positions corresponding to these projections 7*d* . . . with a diameter approximately identical to an outer diameter of these projections 7*d* . . . . The projections 7*d* . . . of the spacer main body 7 are passed through the through-holes 8*a* . . . on the regulating portion 8, and the projection ends are thermally crimped, thus supporting the regulating portion 8 by the spacer main body 7. Thus, similar to the above-described examples, the spacer 6 including the regulating portion 8 supported to the spacer main body 7 via the thermal crimp of the projections 7*d* . . . is also disposed in the water jacket 3 in the cylinder block 1. In this disposed state, the cooling water flows through the water jacket 3. When the cellulose-based sponge 81 of the regulating portion 8 contacts the cooling water, as indicated by the two-dot chain lines, the cellulose-based sponge 81 restores the state before the compression by the part on the cylinder bore 2 side. Accordingly, the surface of the regulating portion 8 abuts on the inner wall surface 3*c* on the cylinder bore 2 side of the water jacket 3 (same as above). Accordingly, the spacer 6 of this example also provides the actions and the effects similar to the above-described examples.

Figure 9:
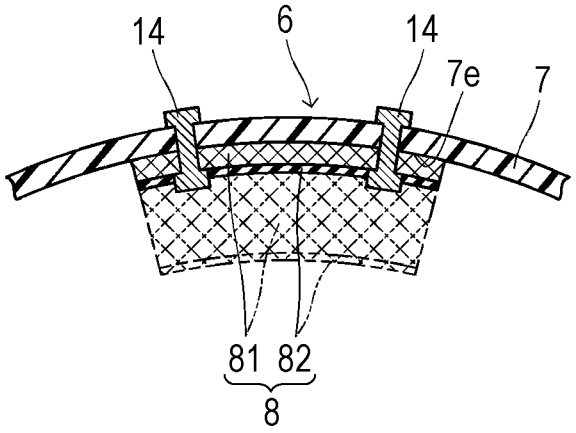
FIG. 9 is a traverse plan view of main parts illustrating yet another example of the supporting structure.

FIG. 9 illustrates yet another example of a structure where the spacer main body (supporting member) 7 supports the regulating portion 8 of the embodiment. In this example, with the regulating portion 8 along the inner surface on the cylinder bore 2 side of the spacer main body 7, four rivets 14 . . . , which pass through the spacer main body 7 and the regulating portion 8 in the thickness direction, integrally support the regulating portion 8 to the spacer main body 7. Thus, similar to the above-described examples, the spacer 6 including the regulating portion 8 supported to the spacer main body 7 via the rivets 14 . . . is also disposed in the water jacket 3 in the cylinder block 1. In this disposed state, the cooling water flows through the water jacket 3. When the cellulose-based sponge 81 of the regulating portion 8 contacts the cooling water, as indicated by the two-dot chain lines, the cellulose-based sponge 81 restores the state before the compression by the part on the cylinder bore 2 side. Accordingly, the surface of the regulating portion 8 abuts on the inner wall surface 3*c* on the cylinder bore 2 side of the water jacket 3 (same as above). Accordingly, the spacer 6 of this example also provides the actions and the effects similar to the above-described examples.

Figure 10:
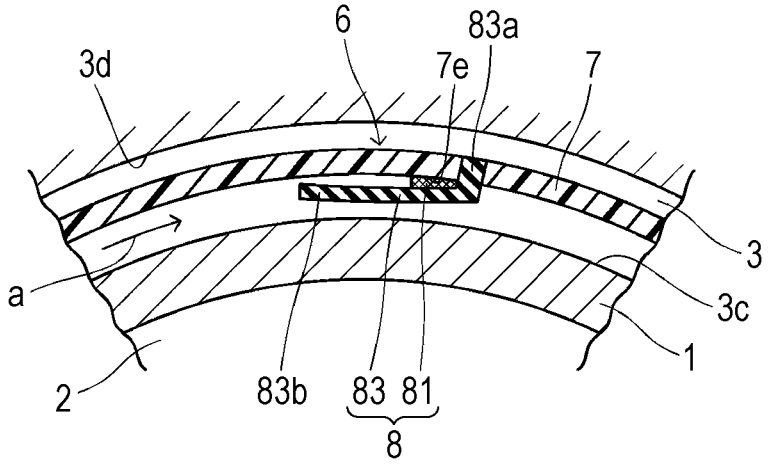
FIGS. 10(*a*) and 10(*b*) schematically illustrate traverse plan views of main parts of a regulating member according to another embodiment of the present invention.
Figure 10:
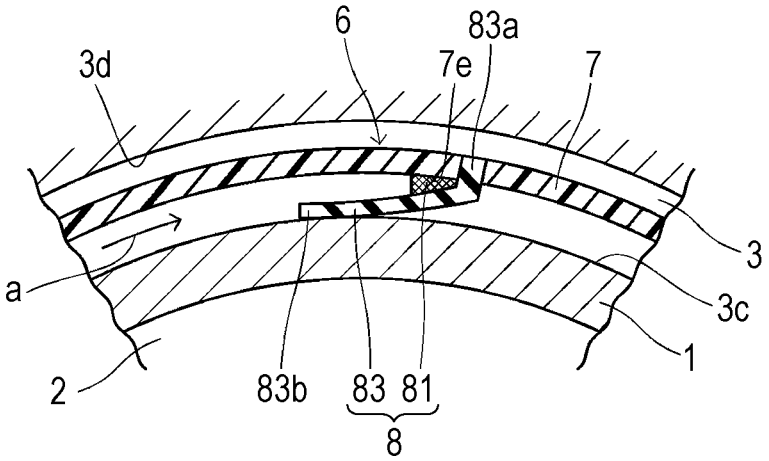

FIGS. 10(*a*) and 10(*b*) illustrate a regulating member according to another embodiment of the present invention. Similar to the above-described examples, the regulating member 6 of this example is also disposed in the water jacket 3. The spacer 6 as this regulating member includes the spacer main body (supporting member) 7 and the regulating portion 8 supported by this spacer main body 7 similar to the above-described examples. The regulating portion 8 is constituted of a rubber lip 83, which is fixedly secured to an inner surface 7*e* of the spacer main body 7, and the cellulose-based sponge 81. The cellulose-based sponge 81 is disposed between a fixedly-secured base portion 83*a* of the rubber lip 83 with respect to the spacer main body 7 and the inner surface 7*e* of the spacer main body 7. The lip 83 is bent from the fixedly-secured base portion 83*a*. The lip 83 is formed such that an other-side-side portion 83*b* is opposed to a flowing direction a of the cooling water and the other-side-side portion 83*b* does not contact the inner wall surface 3*c* on the cylinder bore 2 side. The compressed cellulose-based sponge 81 is fixedly secured to and integrated with at least one of the lip 83 and the spacer main body 7. As illustrated in FIG. 10(*b*), with the spacer 6 according to this embodiment, when the cooling water flows through the inside of the water jacket 3, the cellulose-based sponge 81 restores the state before the compression. The cellulose-based sponge 81 pushes out the lip 83 to the cylinder bore 2 side. Consequently, the lip 83 is elastically deformed so as to approach the inner wall surface 3*c* of the water jacket 3. Finally, a part on the other-side-side portion 83*b* side elastically contacts the inner wall surface 3*c* on the water jacket 3. Accordingly, the regulating portion 8 regulates the flow of the cooling water nearby the regulating portion 8.

Figure 11:
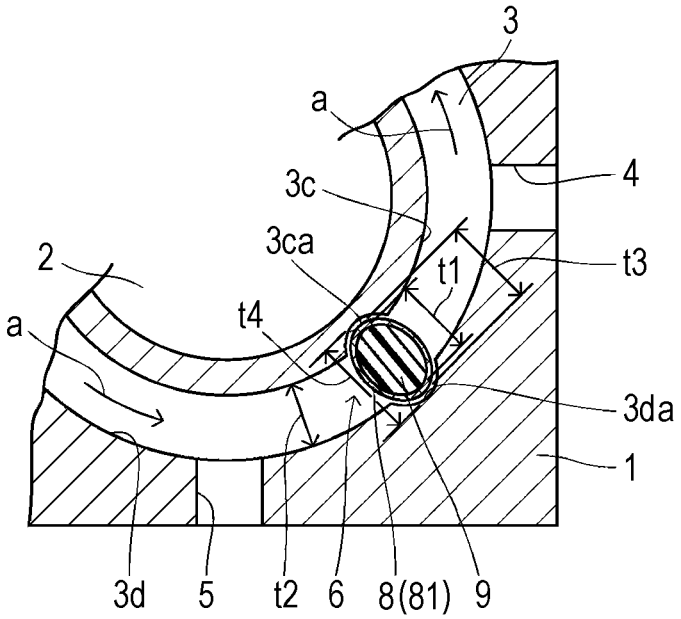
FIGS. 11(*a*) and 11(*b*) schematically illustrate traverse plan views of main parts of a regulating member according to yet another embodiment of the present invention.
Figure 11:
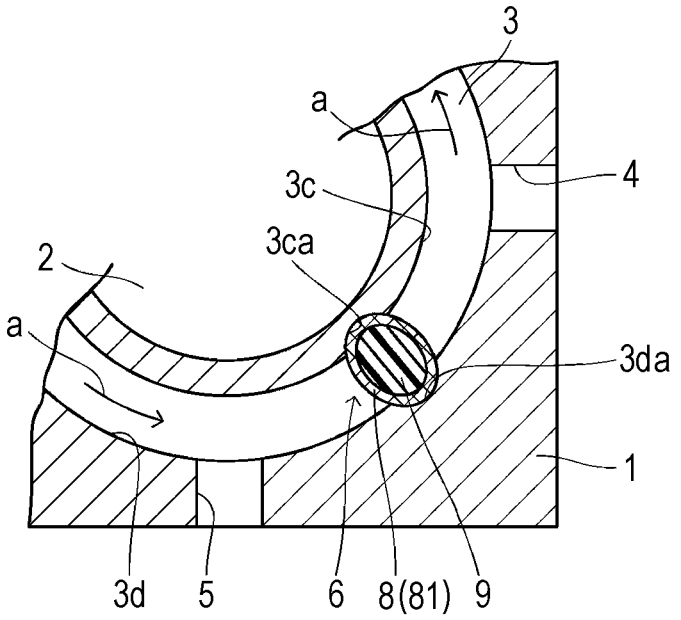

FIGS. 11(*a*) and 11(*b*) illustrate a regulating member according to yet another embodiment of the present invention. Similar to the above-described examples, the regulating member 6 of this example is also disposed in the water jacket 3. The regulating member 6 is disposed in the shortest route from the cooling water introduction port 4 to the cooling water discharge port 5 of the water jacket 3. This regulating member 6 has a function to dam the flow of the cooling water at this part. This regulating member 6 includes a pillar core material 9, which is as a supporting member made of resin, and the regulating portion 8, which is supported so as to cover an outer peripheral surface of this core material 9. The regulating portion 8 is constituted of the compressed cellulose-based sponge 81 fixedly secured and integrated with the adhesive so as to cover the outer peripheral surface of the core material 9. The core material 9 is formed of a rod-shaped body tapered off downward along the depth direction of the water jacket 3. Concave portions 3*ca* and 3*da* are formed on both inner wall surfaces 3*c* and 3*d* of the water jacket 3 where this regulating member 6 is disposed, which are in a relationship opposed to one another. The regulating member 6 is positioned in the water jacket 3 such that both side portions of the regulating member 6 are fitted to these concave portions 3*ca* and 3*da*. In this case, a width dimension t1 of the core material 9 is configured larger than a groove width dimension t2 of the water jacket 3. A width dimension t3 including the compressed cellulose-based sponge 81 is configured smaller than the maximum width t4 between the concave portions 3*ca* and 3*da*. When the cooling water flows through the water jacket 3, as illustrated in FIG. 11(*b*), the cellulose-based sponge 81 is restored from the compressed state and abuts on the inner surfaces of the concave portions 3*ca* and 3*da*. This shuts off the flowing of the cooling water attempting to head for the cooling water discharge port 5 at the shortest route from the cooling water introduction port 4. Therefore, the cooling water introduced from the cooling water introduction port 4 is, as indicated by an arrow a (flowing direction), approximately rounds an approximately whole circumference of the water jacket 3 in one direction. After that, the cooling water is discharged from the cooling water discharge port 5 to a cylinder head (not illustrated) side.

Figure 12:
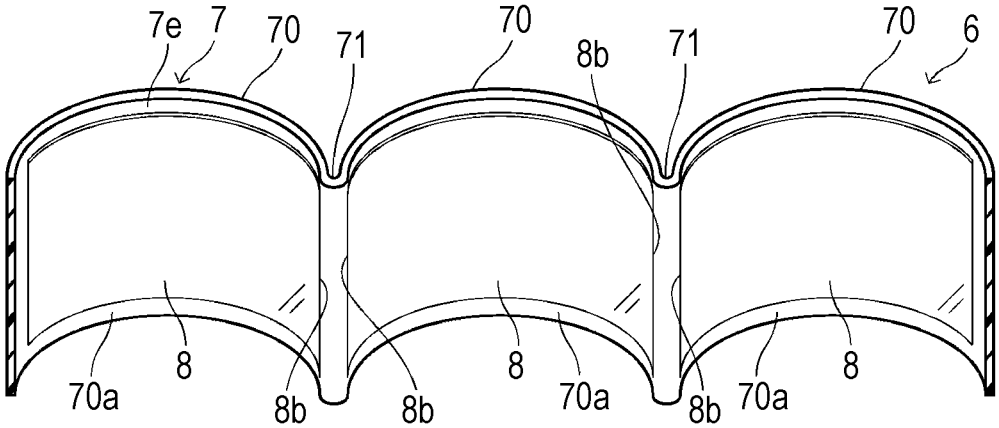
FIG. 12 illustrates an example of a fixedly-secured state of the regulating member according to the embodiment.
Figure 13:
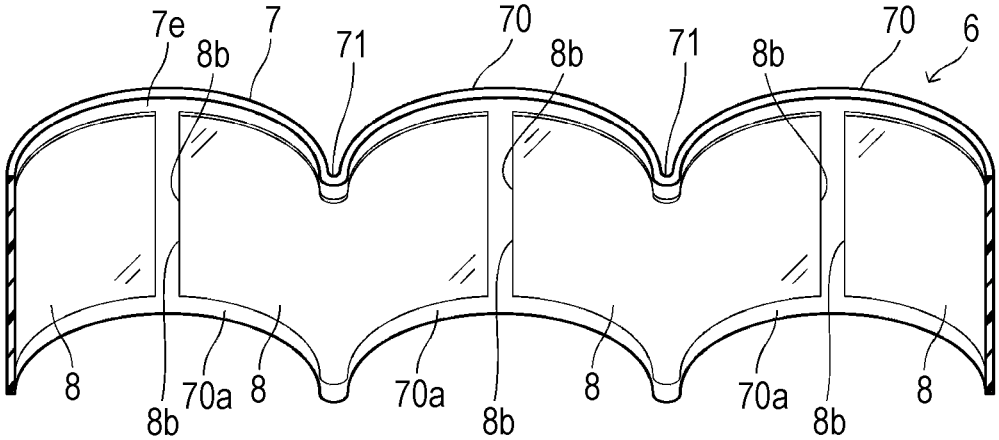
FIG. 13 illustrates another example of the fixedly-secured state of the regulating member according to the embodiment.
Figure 14:
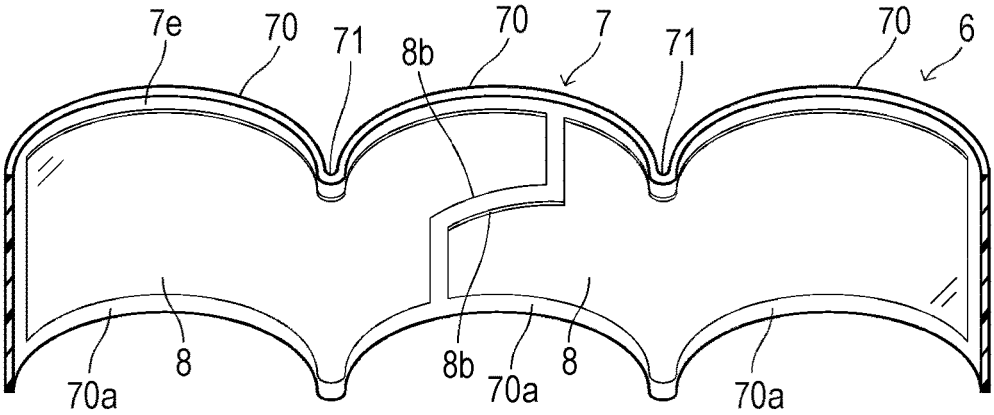
FIGS. 14(*a*) and 14(*b*) illustrate yet another example of the fixedly-secured state of the regulating member according to the embodiment.
Figure 14:
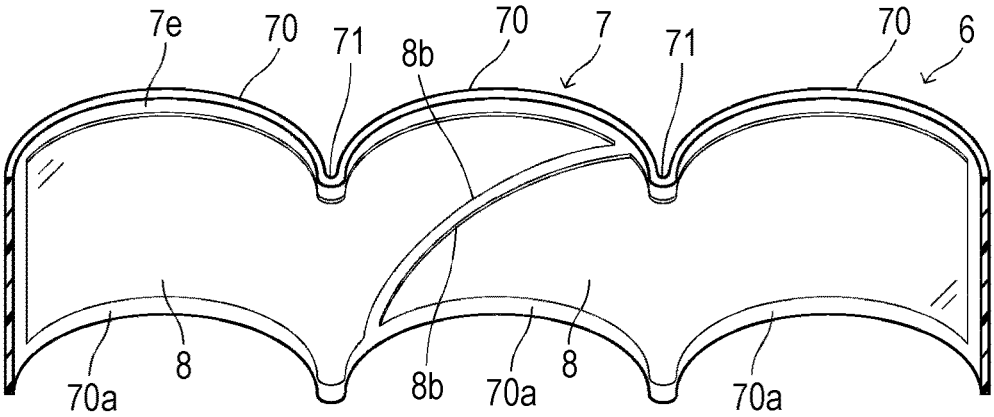

FIGS. 12 to 14 illustrate various examples of the fixedly-secured state of the regulating portion of the embodiment. These examples describe the examples of the regulating portions 8 fixedly secured to and integrated with the spacer main body 7 by the insert molding Note that, like the embodiments in FIGS. 1 to 3(*b*), the regulating portion 8 may be fixedly secured to the spacer main body 7 with the adhesive. Alternatively, the regulating portion 8 may be supported to the spacer main body 7 using the supporting structure described illustrated in FIGS. 4(*a*) to 9. Identical reference numerals are attached to parts common between FIGS. 12 to 14. The following omits the overlapping description. Although the details are not illustrated, FIGS. 12 to 14 employ a regulating member as the regulating portion 8 that includes the cellulose-based sponge 81 restorable from the compressed state through the contact with the cooling water similar to the above description. The embodiments in FIGS. 12 to 14 may employ the regulating portion 8 including the protecting material 82 made of the rubber material to coat the surface of the cellulose-based sponge 81. Further, FIGS. 12 to 14 are perspective cross-sectional views schematically illustrating an arrow portion taken along line Z-Z in FIG. 1. All the drawings illustrate examples of the regulating portion 8 fixedly secured to the inner surface 7*e* of the spacer main body 7. A size and a shape of the regulating portion 8, the number of fixedly-secured regulating portions 8, and the like are not limited to these. The regulating portion 8 may be fixedly secured to the outer surface of the spacer main body 7. Alternatively, the regulating portion 8 may be fixedly secured to both the inner surface 7*e* and the outer surface of the spacer main body 7. For example, like the example illustrated in FIG. 2, the regulating portion 8 may be fixedly secured to the crankshaft 11*f* side in the depth direction of the water jacket 3.

As illustrated in FIG. 12, the spacer main body 7 includes arc portions 70, which are formed along an outer shape of the cylinder bore wall 2*a*, and coupling portions 71, which are formed projecting inward so as to go along the outer shape of the narrowed portion 3*a* of the water jacket 3. End portions 8*b* and 8*b* of the regulating portions 8 fixedly secured adjacent to one another are linearly formed. The end portions 8*b* and 8*b* are fixedly secured with a certain clearance to avoid the end portions 8*b* and 8*b* to be fixedly secured to the parts of coupling portions 71. The arc portions 70 are formed according to the number of cylinder bores 2. The coupling portions 71 are formed between the arc portion 70 and the arc portion 70. The arc portion 70 includes a curved surface inner peripheral surface 70*a* (inner surface 7*e*) along the inner wall surface 3*c* on the cylinder bore 2 side and a curved outer peripheral surface (not illustrated) along the outer inner wall surface 3*d*, which is disposed on a side opposite to the cylinder bore 2. In FIG. 12, the regulating portion 8 may be divided into the plurality of respective arc portions 70, 70, and 70 to so as not to cross the coupling portions 71.

Thus, as long as the regulating portions 8 are divided so as not to cross the coupling portions 71, this ensures preventing hindrance of the restoration of the regulating portion 8 due to a pulling of the regulating portion 8 when the restoration from the compressed state and the like.

The shape of the end portions 8*b* and 8*b* of the regulating portions 8 fixedly secured adjacent to one another and the like are not limited to the example in the diagram.

FIG. 13 is an example different from FIG. 12 in that the regulating portion 8 is disposed so as to cross the one coupling portion 71. With the configuration where the regulating portion 8 crosses the only one coupling portion 71 at most, when the regulating portion 8 is integrally molded with the spacer main body 7, a wrinkle in the regulating portion 8 or the damage of the regulating portion 8 is restrained.

In this example as well, the shape of the end portions 8*b* and 8*b* of the regulating portions 8 fixedly secured adjacent to one another and the like are not limited to the example in the diagram.

With the examples illustrated in FIGS. 14(*a*) and 14(*b*), the plurality of fixedly-secured regulating portions 8 are adjacently disposed. Furthermore, at least a part of the plurality of regulating portions 8 overlap in the depth direction of the water jacket 3. In this case as well, the regulating portions 8 are fixedly secured to the spacer main bodies 7 so as not to cross the two or more coupling portions 71.

In the example illustrated in FIG. 14(*a*), the end portions 8*b* and 8*b* of the adjacent regulating portions 8 facing to one another are formed in a stepped manner. The regulating portions 8 adjacent to one anther are fixedly secured at a certain clearance in alternation to avoid an overlap with one another. In the example illustrated in FIG. 14(*b*), the end portions 8*b* and 8*b* of the adjacent regulating portions 8 facing to one another are formed in an inclination manner. The regulating portions 8 adjacent to one anther are fixedly secured at a certain clearance to avoid an overlap with one another.

According to this, the flow of the cooling water in an unintended direction due to a flow of the water in a gap between the regulating portion 8 and the regulating portion 8, which is generated by plurally dividing the regulating portions 8, and the like can be prevented.

The shape of the end portions 8*b* and 8*b* of the adjacent regulating portions 8 facing to one another is not limited to the example in the diagram. For example, the shape of the end portions 8*b* and 8*b* may be the wave shape, or the one end portion 8*b* may be a concave shape and the other end portion 8*b* may be a convex shape. Insofar as the end portions 8*b* and 8*b* of the adjacent regulating portions 8 facing to one another do not overlap, extending portions projecting in alternation may be formed. The shape of the end portion 8*b* of the regulating portion 8 illustrated in FIGS. 14(*a*) and 14(*b*) is applied to a configuration that includes the plurality of regulating portions 8 crossing the one coupling portion 71. Note that, the shape of the end portion 8*b* may be applied to the case where the plurality of regulating portions 8 do not cross the coupling portion 71 but are disposed in the one arc portion 70.

The cellulose-based sponge 81 is not specifically limited. The cellulose-based sponge 81 includes various kinds of the cellulose-based sponges 81. For example, any of a fine product with pores of a considerably small size, a small product with pores of a small size, and a medium product with pores of a medium size can be used. The sizes of these pores are determined by granularity of crystal Glauber's salt used in the manufacturing process of the cellulose-based sponge. The cellulose-based sponge 81 may be compressed such that a volume in the compressed state becomes 1% to 30% with respect to a volume in the non-compressed state. The cellulose-based sponge 81 may be preferably compressed to be 2% to 15%. An average pore diameter of the non-compressed cellulose-based sponge 81 may be 0.1 mm to 3.5 mm. This average grain diameter is preferably 0.5 mm to 1.0 mm. An apparent specific gravity of the cellulose-based sponge 81 in the non-compressed state and the dried state may be 0.02 g/cc ($2\times10$ kg/m$^3$ to 0.06 g/cc ($6\times10$ kg/m$^3$). This apparent specific gravity is preferably 0.035 g/cc (3.5×10 kg/m$^3$) to 0.045 g/cc (4.5×10 kg/m$^3$). Furthermore, the cellulose-based sponge 81 is not limited to the cellulose-based sponge 81 made of the cellulose and the reinforcing fiber. The cellulose-based sponge 81 constituted of the cellulose alone may be used. In addition to the sponge made of the cellulose itself, the cellulose-based sponge 81 may be a cellulose derivative, for example, selected from a sponge made of, for example, cellulose ethers and cellulose esters or a sponge made of a mixture of these materials.

The embodiment describes the example where the protecting material 82 coats the entire surface of the one surface (the surface on the side opposite to the side supported to the spacer main body 7) of the cellulose-based sponge 81. Note that, the protecting material 82 may be the protecting material coated on a part of this one surface. As an aspect of this partial coating, a lateral stripe shape, a vertical stripe shape, a wave shape, a spotted shape, and other aspects are possible. An aspect that, even if the protecting material 82 abuts on the opposed wall surface 3*c* on the water jacket 3, the exposed surface of the cellulose-based sponge 81 does not abut on this opposed wall surface 3*c* is preferable. For example, in the case where the cellulose-based sponge 81 has some extent of toughness and rubfastness and only the performance of the cellulose-based sponge 81 meets required specifications, the coating by the protecting material 82 may be eliminated. Furthermore, to further enhance heat insulation performance of the regulating portion 8, a heat insulating layer with heat insulation performance higher than (thermal conductivity lower than) the cellulose-based sponge may be disposed on the one surface (the surface on the side opposite to the side supported to the spacer main body 7) of the cellulose-based sponge 81.

Additionally, the example of the spacer main body 7 formed of the molded body of the synthetic resin is described. Note that, as long as the material has the rigidity more than that of the cellulose-based sponge 81 such as the metal, the spacer main body 7 may be formed of a formed body of another material. The position of the spacer main body 7 to which the regulating portion 8 is fixedly secured may be appropriately changed according to a purpose. For example, the regulating portion 8 may be fixedly secured to a site of the inner surface 7*e* on the spacer main body 7 equivalent to the narrowed portion 3*a* of the water jacket 3. The spacer main body 7 has a cylindrical body matching the entire shape of the water jacket 3. Note that, the spacer main body 7 may configure a so-called partial spacer that can be disposed at an appropriate position inside the water jacket 3. That is, as long as the spacer main body 7 can function as the supporting member to support the regulating portion 8, the spacer main body 7 may have any shape. Furthermore, the opposed wall surface to which the surface of the regulating portion 8 restored from the compressed state abuts on is the inner wall surface 3*c* on the cylinder bore 2 side of the water jacket 3. However, this should not be constructed in a limiting sense. The opposed wall surface to which the surface of the regulating portion 8 abuts on may be the outer inner wall surface 3*d*. In this case, the outer surface (the surface on the side opposite to the cylinder bore 2) of the spacer main body 7 supports the regulating portion 8. Furthermore, as the internal combustion engine that applies the spacer of the present invention, the three-cylinder engine is described as the example. However, this should not be constructed in a limiting sense. The spacer of the present invention is also applicable to an engine with different number of cylinders.

LIST OF REFERENCE NUMERALS

1: Cylinder block
2: Cylinder bore
3: Water jacket (cooling water flow passage)
3*c*, 3*d*: Inner wall surface of water jacket (wall surface, opposed wall surface)
30: Opening
6: Spacer (regulating member)
7: Spacer main body (supporting member)
8: Regulating portion
81: Cellulose-based sponge
82: Protecting material
9: Core material (supporting member)
11: Piston
11*a*: Piston ring closest to combustion chamber
11*f*: Crankshaft
d: Sum of thickness of compressed regulating portion
D: Width of water jacket (cooling water flow passage)
w: Cooling water

The invention claimed is:

1. A regulating member inserted from an opening of a cooling water flow passage into the cooling water flow passage to be disposed, the cooling water flow passage being disposed in a cylinder block in an internal combustion engine, the regulating member comprising:

a supporting member with rigidity formed into a shape configured to be disposed in the cooling water flow passage; and a regulating portion supported by the supporting member, the regulating portion regulating a flow of cooling water flowing through the cooling water flow passage, wherein the regulating portion includes a cellulose-based sponge, the cellulose-based sponge being restorable from a compressed state through a contact with the cooling water flowing through the cooling water passage.

2. The regulating member according to claim 1, wherein the regulating portion further includes a protecting material, the protecting material coating at least a part of a surface opposed to a wall surface of the cooling water flow passage of the cellulose-based sponge, the protecting material having a strength larger than a strength of the cellulose-based sponge.

3. The regulating member according to claim 2, wherein the protecting material is made of an elastic material.

4. The regulating member according to claim 1, wherein a sum of thicknesses of the supporting member and the compressed regulating portion is smaller than a width of the cooling water flow passage.

5. The regulating member according to claim 4, wherein a surface of the regulating portion restored from the compressed state is configured to abut on an opposed wall surface of the cooling water flow passage.

6. The regulating member according to claim 1, wherein:

the supporting member includes an arc portion formed along an outer shape of a cylinder bore wall disposed in the internal combustion engine, and the regulating portion is fixedly secured to the arc portion.

7. The regulating member according to claim 6, wherein the regulating portion is fixedly secured on each of an arc surface on the cylinder bore side and an arc surface on a side opposed to the cylinder bore.

8. The regulating member according to claim 6, wherein:

the supporting member includes a plurality of the arc portions and a coupling portion, the coupling portion coupling the adjacent arc portions, and the regulating portions are dividedly disposed at a plurality of the respective arc portions not to cross the coupling portion.

9. The regulating member according to claim 1, wherein at least a part of a plurality of the regulating portions adjacently overlap in a depth direction of the cooling water flow passage.

10. The regulating member according to claim 1, wherein:

the regulating portion is disposed on a cylinder bore side of the supporting member, and when a piston in the internal combustion engine is at a top dead center, the regulating portion is disposed at a crankshaft side with respect to a position of a piston ring closest to a combustion chamber.

11. The regulating member according to claim 1, wherein the supporting member is made of resin, and wherein a portion of the resin impregnates the regulating portion to fixedly secure the regulating portion to the spacer main body.

12. The regulating member according to claim 11, wherein the cellulose-based sponge is made of a cellulose derived from a pulp and of a reinforcing fiber.

13. The regulating member according to claim 11, wherein the cellulose-based sponge is compressed such that a volume in the compressed state becomes 1% to 30% with respect to a volume in the non-compressed state.

14. The regulating member according to claim 1, wherein the cellulose-based sponge is made of a cellulose derived from a pulp and of a reinforcing fiber.

15. The regulating member according to claim 14, wherein the cellulose-based sponge is compressed such that a volume in the compressed state becomes 1% to 30% with respect to a volume in the non-compressed state.

16. The regulating member according to claim 1, wherein the cellulose-based sponge is compressed such that a volume in the compressed state becomes 1% to 30% with respect to a volume in the non-compressed state.

* * * * *